US005956783A

United States Patent [19]

Powell

[11] Patent Number: 5,956,783

[45] Date of Patent: Sep. 28, 1999

[54] SWIMMING POOL COVER STORAGE APPARATUS

[76] Inventor: Cynthia Powell, 2515 Willard, Saginaw, Mich. 48602

[21] Appl. No.: 08/928,911

[22] Filed: Sep. 12, 1997

[51] Int. Cl.[6] ..... E04H 3/19

[52] U.S. Cl. ..... 4/500

[58] Field of Search ..... 4/498, 500, 502, 4/496; 248/215

[56] References Cited

U.S. PATENT DOCUMENTS

| | | | |
|---|---|---|---|
| 3,707,007 | 12/1972 | Trostler | 4/172 |
| 3,916,457 | 11/1975 | Morita | 4/172 |
| 4,991,238 | 2/1991 | Forrest | 4/498 |
| 5,068,928 | 12/1991 | Powell | 4/500 |
| 5,107,552 | 4/1992 | Lavalliere et al. | 4/502 |
| 5,232,189 | 8/1993 | Koch | 258/683 |
| 5,471,685 | 12/1995 | Cross | 4/500 |
| 5,593,122 | 1/1997 | Robertson et al. | 4/496 |

*Primary Examiner*—Charles E. Phillips

[57] ABSTRACT

A one-piece device for storing a pool cover which is removed from a position covering a swimming pool, having an upstanding perimeter sidewall, to a position adjacent the sidewall. The device includes a pair of U-shaped storage members having upper legs which are integrally coupled together and integral lower legs which cooperate to define an inwardly receiving opening. Mount members, which are integral with the lower legs, are provided for mounting the U-shaped storage members in a position in which the upper legs and at least a portion of the opening is disposed at a level above the upper end of the pool sidewall.

5 Claims, 4 Drawing Sheets

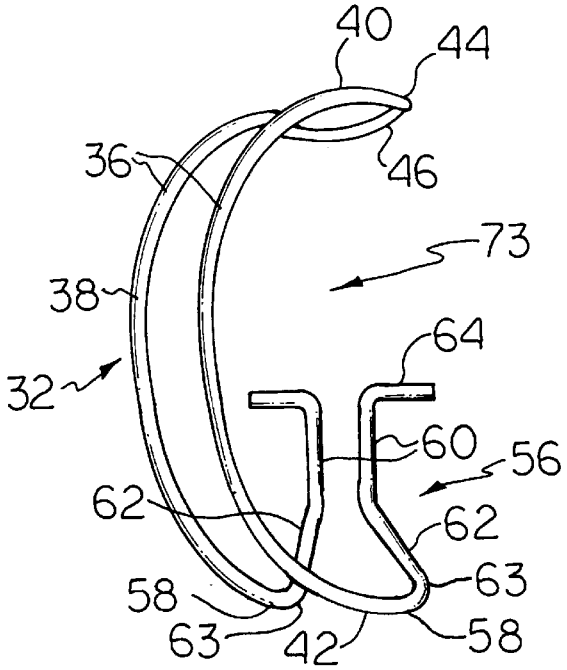
Fig. 2
Fig. 3
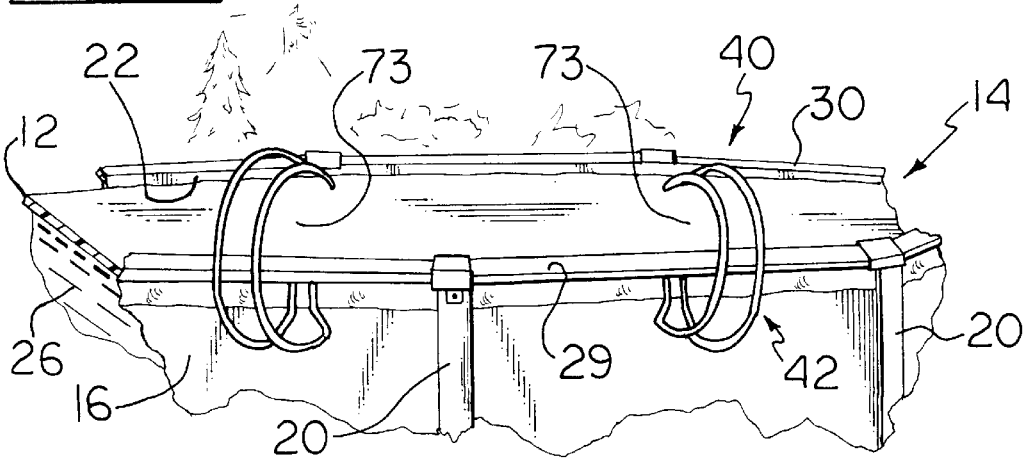

SWIMMING POOL COVER STORAGE APPARATUS

BACKGROUND OF THE INVENTION

1. Field of the Invention

This invention relates to a pool cover storage device and, more particularly, to a device which can be mounted on a swimming pool and includes a horizontally inwardly opening receptacle that extends to a level substantially above a pool sidewall to receive and store a pool cover which is removed from a position covering an above ground pool.

2. Description of the Prior Art and Objects

Above ground swimming pools typically include an upstanding, outer perimeter sidewall and are typically covered by a removeable cover which could suitably comprise a solar cover for heating the water. Apparatus has been provided heretofore for storing a folded or rolled pool cover along the exterior sidewall of an above ground pool such as that disclosed in Applicant's prior U.S. Pat. No. 5,068,928 issued Dec. 3, 1991. The device disclosed in the aforementioned patent is cantileverly supported adjacent the upper end of the pool sidewall and includes an upwardly opening receptacle disposed alongside the sidewall into which the pool cover is deposited. It is sometimes difficult, particularly for children, to remove a pool cover stored in the prior art device as the pool cover must be vertically lifted a substantial distance out of the prior art storage device before unrolling or unfolding the pool cover prior to recovering the pool. Accordingly, it is an object of the present invention to provide a new and novel pool cover storage device which will enhance the removal of a pool cover stored therein.

It is a further object of the present invention to provide a generally U-shaped pool storage device of the type described including upper and lower legs and mount mechanism for mounting the pool storage device on a pool with the upper inner ends of the upper legs extending at a level above a pool sidewall and the inner ends of the lower legs disposed adjacent the sidewall at a level below the upper end of the sidewall.

The prior art pool cover storage device, which comprises a single strip of yieldable material, can be unstable, depending on the weight of the pool cover to be disposed therein. Accordingly, it is another object of the present invention to provide a pool cover storage device which is more stable than the prior art storage device.

It is another object of the present invention to provide a pool cover storage device which includes a horizontally inwardly opening opening for receiving a pool cover.

It is a further object of the present invention to provide a pool cover storage device including one-piece, U-shaped pool cover storage receptacle having a base with an upper leg which is disposed at a level above the upper end of a pool sidewall and a lower leg which is disposed adjacent the sidewall below the upper end of the sidewall.

Another object of the present invention is to provide a pool cover storage device constructed according to the present invention including a pair of U-shaped pool storage members each defining an opening which opens inwardly toward the pool, each of the U-shaped members including a pair of upper legs which are integrally coupled to each other and a pair of lower legs which are supported by the pool sidewall.

It is another object of the present invention to provide a pool cover storage device of the type described which is disposed at a level in which a substantial portion of the device, as well as the opening therein, extends at a level above the level of the pool sidewall for storing a substantial portion of the pool cover at a level above the level above the upper end of the sidewall.

Another problem with the prior art storage device illustrated in the aforementioned patent, is that it did not universally fit all pools because the rims or lips of the pools are of different sizes and shapes. Accordingly, it is another object of the present invention to provide pool cover storage device which can be universally mounted on above ground pools.

Other objects and advantages of the present invention will become apparent to those of ordinary skill in the art as the description thereof proceeds.

SUMMARY OF THE INVENTION

A one-piece pool cover storage device for storing a pool cover removed from a position covering a swimming pool having an upstanding, perimeter, outer sidewall, the device comprising: a U-shaped, pool cover storage receiving member having a pair of legs which define a pool cover receiving opening; and mount mechanism supporting the U-shaped member on a pool sidewall such that one of the legs, and a substantial part of the opening, is at a level above the pool sidewall and the other leg is mounted adjacent the pool sidewall.

DESCRIPTION OF THE DRAWINGS

The invention may be more readily understood by referring to the accompanying drawings, in which:

FIG. 2 is a slightly reduced, rear end perspective view of the pool storage device only;

FIG. 3 is a further reduced, rear end perspective view illustrating a plurality of the pool cover storage devices mounted on a pool;

DESCRIPTION OF PREFERRED EMBODIMENT

Figure 1:
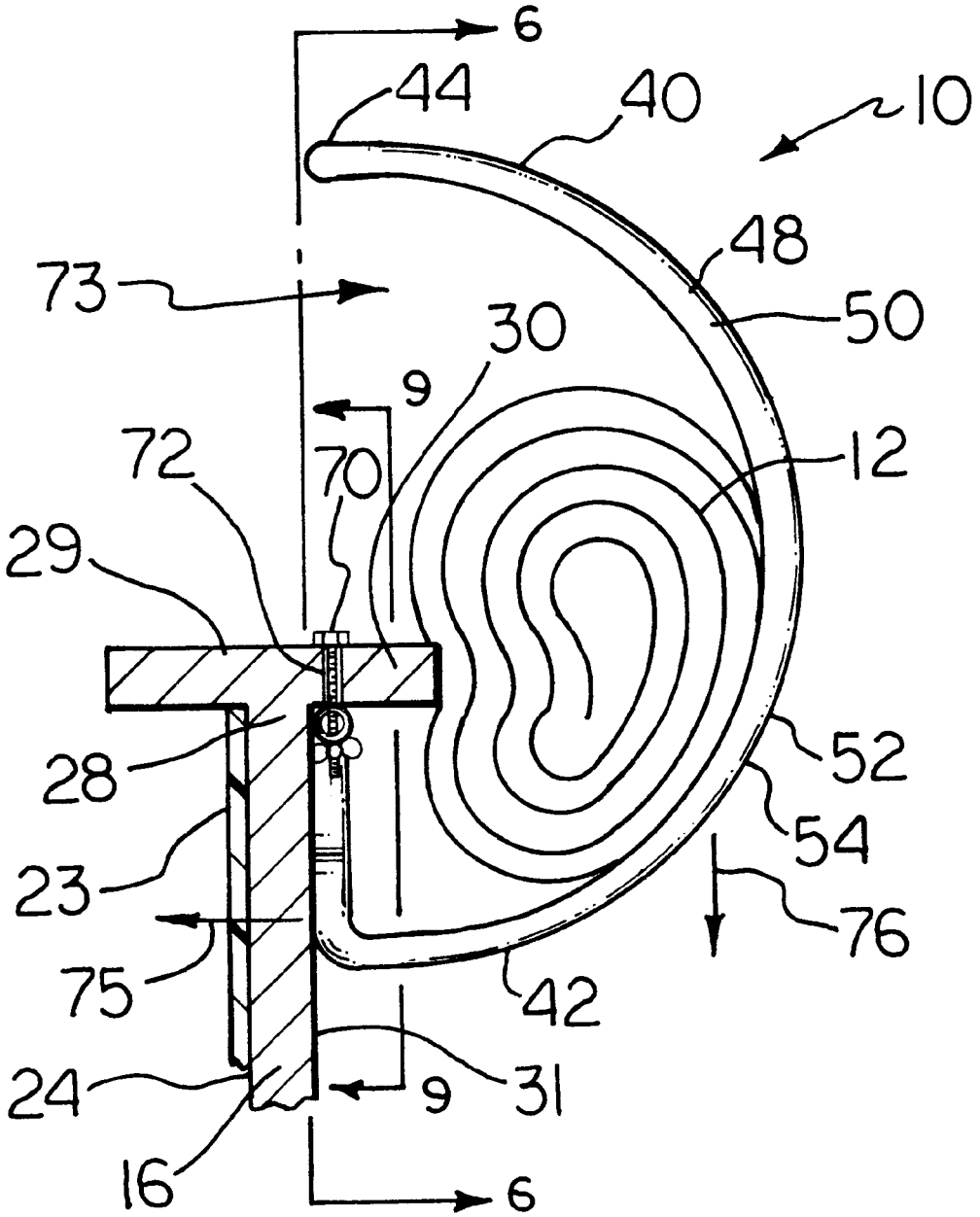
FIG. 1 is a sectional side view taken along the section line 1—1 of FIG. 6, illustrating a pool storage device, constructed according to the present invention, supported by a pool sidewall.

A pool storage device, generally designated 10, constructed according to the present invention, is provided for storing a pool cover, generally designated 12, utilized to cover an above ground swimming pool, generally designated 14. The pool 14 includes an upstanding, outer perimeter annular, endless wall, generally designated 16, supported about its circumference via a plurality of circumferentially spaced apart, upstanding posts 20. A cup shaped water impervious liner 22 lines the inside of the pool 12 and includes an upstanding wall portion 23 disposed against the inner surface 24 of the wall 16 for holding water, generally designated 26. The upper end portion 28 of the upstanding outer wall 16 mounts an inwardly and outwardly extending flange, rim, or step 30 utilized as a support for gaining access to the water 26 inside the pool. The cover 12 floats on the surface of the water 26 (FIG. 3) to prevent dirt, leaves, debris and other air-born foreign matter from entering the pool water 26. The cover 12 may suitably comprise a solar cover for heating the pool water. The cover 12 is folded or rolled from a generally planar, pool covering position, illustrated in FIG. 3, to a removed, stowed position, illustrated in FIGS. 1, 4 and 5.

Figure 4:
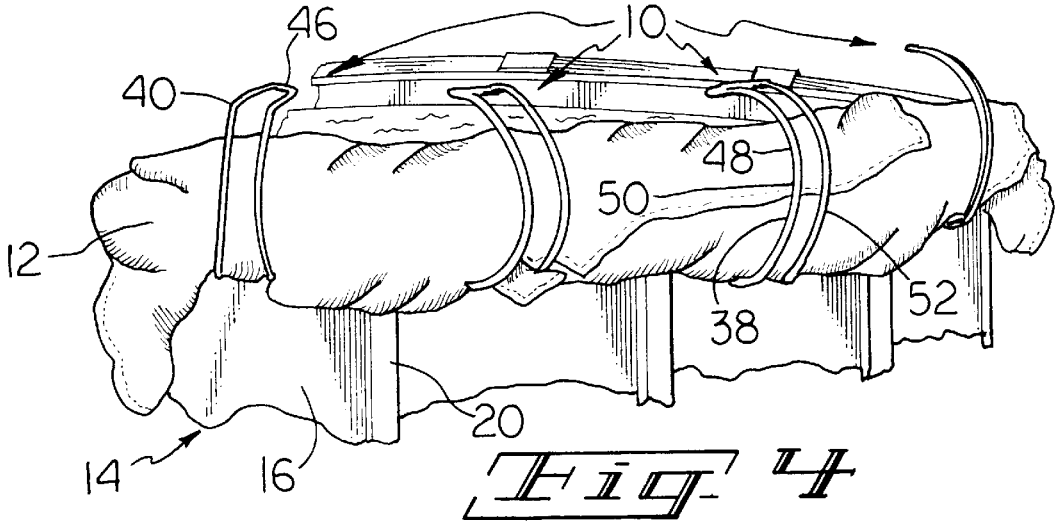
FIG. 4 is a further reduced rear end perspective view illustrating a plurality of pool storage devices, supported by the sidewall of an above ground swimming pool supporting a pool cover.
Figure 5:
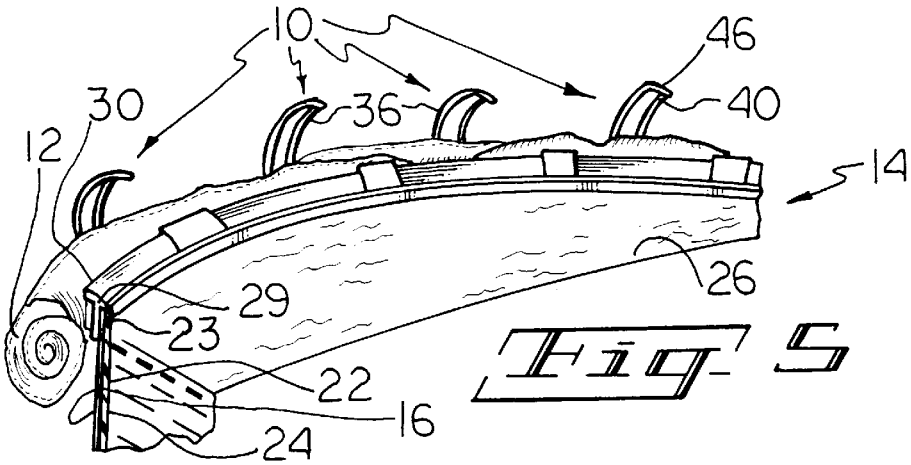
FIG. 5 is a further reduced, opposite front end perspective view illustrating the pool cover stored disposed in a plurality of the pool cover storage devices supported by a pool sidewall.

As illustrated in FIGS. 3, 4 and 5, a plurality of perimetrically spaced apart pool storage devices 10 are mounted on the pool 14 adjacent the outside surface 31 of the pool side wall 16. Each pool storage device 10 may suitably comprise a one-piece strip 32 of yieldable plastic material, which is formed in the shape illustrated. The device 10 includes a pair of inwardly opening, laterally spaced apart generally U-shaped, pool cover receiving members, generally designated 36, each including an upstanding base portion 38 and a pair of integral, upper and lower legs, generally designated 40 and 42, respectively. The upper legs 40 include inner ends 44 which are spanned by an integral yieldable coupling member or base 46 which is disposed at a level substantially above the upper wall end 28 and the step 30. The upper legs 40 include outer ends 48 which are integral with the upper end 50 of the base members 38. The lower ends 52 of the base members 38 are integral with the outer ends 54 of the lower legs 42.

A pair of mount members, generally designated 56, are integrally coupled to the inner ends 58 of the lower legs 42 for mounting each pool cover storage device 10 on the pool laterally outwardly adjacent the upper end 28 of the sidewall 16. Each of the mount members 58 is generally upstanding and includes a linear vertical portion 60 for bearing against the upper end 28 of the outside surface 31 of the sidewall 16 and an integral, lower angled portion 62 which, at its lower end 63, is integral with an inner end 58 of one of the lower legs 42. The lower angled portions 62 diverge laterally outwardly in a downward direction. The mount members 56, which extend upwardly toward the inner leg ends 44 and upper base 46, also each include an upper laterally offset terminal end portion 64 which extends transversely and in perimetrically opposite directions relative to each other. The upper offset portions 64 are coupled to the underside 68 of the upper step 30 via suitable bolt fasteners 70 which pass through aligned apertures 72 and 74 in the step 30 and offset members 64, respectively.

Figure 6:
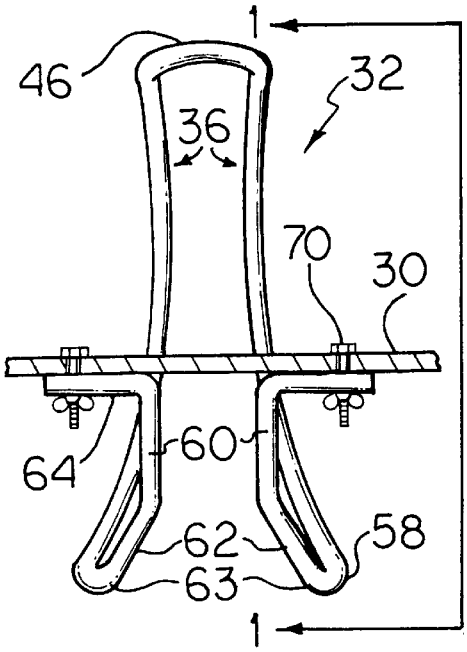
FIG. 6 is a front end sectional view, more particularly illustrating one of the pool storage devices, taken along the section line 6—6 of FIG. 1.
Figure 7:
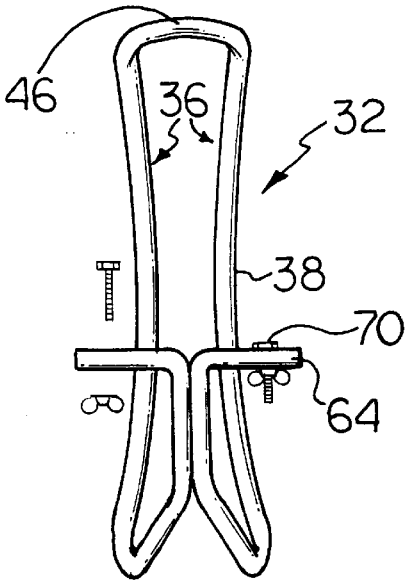
FIG. 7 is a front end view, similar to FIG. 6, illustrating only one of the pool storage devices in a relaxed condition prior to mounting on the pool.
Figure 8:
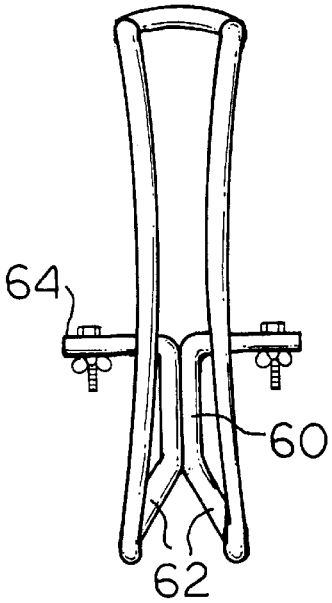
FIG. 8 is a rear end elevational view of the pool storage device illustrated in FIG. 7.

When the pool cover storage device 10 is not mounted, the yieldable coupling member or base 46 urges the linear mount portions 60 into abutting relation, as illustrated in FIGS. 7 and 8. The yieldable base 46 allows the pool cover receiving members 36, when mounted on the pool 14 to spread apart to the spaced apart positions illustrated in FIG. 6.

The upper and lower legs 40 and 42 define an inwardly facing opening or receptacle, 73 for receiving the cover 12 when the cover 12 is rolled, folded and/or otherwise removed from a position covering the pool 14, as illustrated in FIG. 3 to an uncovered stowed position illustrated in FIGS. 1, 4 and 5.

A substantial portion of the pool storage device 10 is disposed above the upper terminal end 29 of the sidewall 16 and the step 30 so that when the pool cover 12 is withdrawn from the pool cover storage unit 10, it need not be lifted vertically any substantial distance and yet, holds the cover 12 outwardly of the pool sidewall 16. The device 10 is adaptable to being universally mounted on any one of a plurality of different shaped pool designs and is not restricted to a single pool design.

The mount members 58 serve as a brace which bears against the outer pool wall surface 32 as the additional weight of the pool cover 12 is supported by the device 10 and tends to move the device 10 downwardly in the direction of the arrow 76. The lower end of the vertical portion 60 will bear against the inside surface 32 as represented by the arrow 75. Accordingly, substantial force is absorbed by the sidewall 16.

THE OPERATION

A plurality of pool storage devices 10 is mounted in circumferentially spaced apart position on the pool 14 via the bolts 70 which are coupled to wall supported step 30 to provide a plurality of inwardly opening receptacles or openings 73 having a substantial portion thereof disposed at a level above, the pool wall 16 and the step 30.

The upstanding linear mount portions 60 are generally parallel and are spread, before mounting, from the abutting positions, illustrated in FIGS. 7 and 8 to the spread positions, illustrated in FIGS. 2 and 6. The lower angled portions 62 diverge laterally outwardly in a downward direction.

Figure 9:
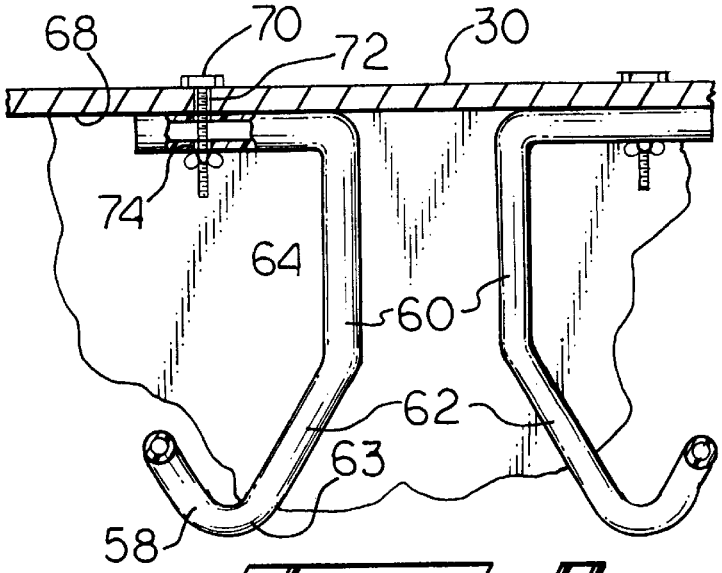
FIG. 9 is a front end sectional view taken along the line 9—9 of FIG. 1.

The base or coupling member 46 spanning the upper inner ends 44 of the U-shaped members 36 comprise yieldable plastic material which urges the U-shaped members 36 together to the positions illustrated in FIGS. 7 and 8 but is yieldable to allow the legs to be spaced apart when mounted as illustrated in FIGS. 2, 6 and 9. The spreading of the U-shaped members 36 against the force of yieldable member 46 tending to move them together, rigidifies the structure by laterally increasing the spacing between the bases 38 and tends to prevent spinning of the members 36 about the bases 38.

The vertical linear portion 60 of the mount member 58 bears against the outer wall surface 32.

Typically, the user will enter the pool and roll the cover 12 into a roll, generally designated 12A, moved to a position outwardly of the pool sidewall 16 received by the opening 73. The weight of the pool cover 12 will tend to move the unit 10 downwardly and swing the device 10 about the bolt fasteners 70. The mount members 58 will bear against the sidewall 32 and preclude swinging movement thereof. The vertical legs 60 operate as a knee or brace which bears against the outer surface 32 of the pool sidewall to preclude the device from swinging inwardly when the pool cover is disposed therein.

The pool cover 12, when stowed in the position illustrated in FIG. 1, can be easily removed through the opening 73 without substantial lifting force, when the pool cover 12 is to be repositioned on the pool, as illustrated in FIG. 2.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In combination with an above-ground swimming pool including an endless, upstanding sidewall having inner and outer wall surfaces and an upper terminal end, and a pool cover removably mounted on said pool for movement from a position covering said pool to a removed, stowed position in which said pool is uncovered, pool cover storage apparatus for storing said pool cover in said removed position, said apparatus comprising:

a plurality of one-piece, perimetrically spaced apart pool cover storage devices each including upper and lower vertically spaced apart legs having inner and outer ends, said outer ends being integrally coupled by an intermediate upstanding base, said inner ends being vertically spaced apart to provide a horizontally inwardly facing opening for freely receiving said pool cover in said removed stowed position, and upstanding mount means, integrally coupled to said lower leg, for supporting said lower leg on said outer wall to dispose said lower leg adjacent said outer wall surface below said upper terminal end and to dispose said inner end of said upper leg at a level substantially above said upper terminal end.

2. The combination set forth in claim 1 wherein said pool cover storage devices each comprise a pair of generally U-shaped members each including upper inner ends, lower inner ends integrally coupled to said mount means, and an upper inner base integrally coupled to said upper inner ends.

3. The combination set forth in claim 2 wherein said mount means includes a pair of upstanding spaced apart mounting bars each having a lower end integrally coupled to one of said lower inner ends and an upper end.

4. The combination set forth in claim 3 wherein said mounting bars each include generally vertical, generally parallel upper portions for bearing against said outer surface of said sidewall and integral lower, downwardly diverging portions integrally coupled to said lower inner ends.

5. The combination set forth in claim 3 wherein each of said mount means includes an upper, laterally outwardly offset terminal end integral with said upper end of each of said upstanding mounting bars.

* * * * *